US005369475A

United States Patent [19]

Kashiwagi

[11] Patent Number: 5,369,475

[45] Date of Patent: Nov. 29, 1994

[54] DEVELOPING ROLL POSITIONING APPARATUS

[75] Inventor: Hiromi Kashiwagi, Fukaya, Japan

[73] Assignee: Hitachi Metals, Ltd., Tokyo, Japan

[21] Appl. No.: 7,629

[22] Filed: Jan. 21, 1993

[30] Foreign Application Priority Data

Jan. 22, 1992 [JP] Japan ..... 4-1729[U]

[51] Int. Cl.[5] ..... G03G 15/06

[52] U.S. Cl. ..... 355/245; 118/656; 118/661; 355/211; 355/259; 355/260

[58] Field of Search ..... 355/245, 211, 246, 250, 355/251, 253, 259, 260, 200; 118/656-658, 661, 651

[56] References Cited

U.S. PATENT DOCUMENTS

| | | | |
|---|---|---|---|
| 4,640,880 | 2/1987 | Kawanishi et al. | 118/657 X |
| 4,989,037 | 1/1991 | Nagatsuna | 355/251 X |
| 5,028,966 | 7/1991 | Kozuka et al. | 355/260 |
| 5,061,968 | 10/1991 | Kita | 355/245 X |
| 5,064,739 | 11/1991 | Asanae et al. | 430/122 |
| 5,089,849 | 2/1992 | Hiraoka | 355/245 X |
| 5,119,137 | 6/1992 | Katgata | 355/245 |
| 5,121,165 | 6/1992 | Yoshida et al. | 355/260 |
| 5,168,308 | 12/1992 | Hiraike et al | 355/245 X |
| 5,182,601 | 1/1993 | Hodoshima et al. | 355/245 X |

*Primary Examiner*—A. T. Grimley
*Assistant Examiner*—Shuk Y. Lee
*Attorney, Agent, or Firm*—McGlew & Tuttle

[57] ABSTRACT

A developing system having a developer tank supporting a developing roll formed by a sleeve incorporating a permanent-magnet member, and guide: rollers having a diameter slightly larger than that of the sleeve, and; fitted at both ends of the sleeve in the longitudinal direction in such a manner as to come in contact with the surface of an image carrier; the developer tank being rotatably supported by a supporting shaft that is supported in parallel with the sleeve by supporting frames provided outside of both ends of the developer tank; the guide rollers and the surface of the image carrier being adapted to be engagable with and disengagable from each other, in with a supporting portion of one end of the supporting shaft and one of the supporting frames is formed in such a manner as to be constrained in motion in the axial direction, and to be movable in the direction vertical to the axis; and the supporting shaft is forced onto the side of the image carrier by a pushing member.

4 Claims, 2 Drawing Sheets

DEVELOPING ROLL POSITIONING APPARATUS

FIELD OF THE INVENTION

This invention relates to a developing system for making an electrostatic charged image formed on the surface of an image carrier visible by using a magnetic developer, and more particularly to a developing system in which the accuracy of a developing gap between a sleeve constituting a developing roll and the surface of an image carrier is improved.

BACKGROUND OF THE INVENTION

A developing system is known for an electrographic system or an electrostatographic system of a type in which a mixture of a magnetic carrier and a toner (magnetic or non-magnetic), or a developer comprising a magnetic toner is used. A magnetic brush is formed on a hollow cylindrical rotatable sleeve made of a non-magnetic material and incorporating a permanent-magnet member. The magnetic brush rubs the surface of an image carrier to make an electrostatic charged image visible.

FIGS. 1 and 2 are a cross-sectional view and a side view illustrating a developing system of a conventional type. In FIGS. 1 and 2, numeral 1 refers to a developer tank housing a developer formed by mixing a magnetic carrier with a triboelectric type magnetic toner (see Specifications of U.S. Pat. Nos. 4,640,880 and 5,064,739) and having on top thereof a toner cartridge housing hole 2. Numeral 3 refers to a movable member or paddle means for transferring and mixing the developer and is rotatably provided in the developer tank 1. Numeral 4 refers to a sleeve made of a non-magnetic material, such as aluminum alloy, stainless steel, etc., formed into a hollow cylindrical shape, and rotatably fitted in the developer tank 1.

Numeral 5 refers to a permanent-magnet member formed into a cylindrical shape by fixedly fitting a cylindrical ferrite magnet to a shaft. The outer circumferential surface of the permanent-magnet 5 has a plurality of magnetic poles extending in the axial direction, and is fitted to the developer tank 1 concentrically and relatively rotatably with respect to the sleeve 4. Numeral 6 refers to a doctor blade provided above the sleeve 4 at a predetermined gap from with the sleeve 4. Numeral 7 refers to guide rollers having a diameter slightly larger than that of the sleeve 4 and provided at both ends of the sleeve 4 in the longitudinal direction in such a manner as to come in contact with the surface of an image carrier 8.

Numeral 9 refers to a supporting shaft supported by supporting frames 10 provided outside of the developer tank 1 in the longitudinal direction in such a manner that the developer tank 1 can be rotated and the guide rollers 7 can be engaged with and disengaged from the surface of the image carrier 8. Numeral 11 refers to a cam formed in such a manner as to be rotatable by a lever 12, and slidably engaged with the cam surface 13 formed on the bottom of the developer tank 1. Numeral 14 refers to a tension coil spring interposed between the developer tank 1 and one of the supporting frames 10.

With the above construction, as the lever 12 is thrown to a position shown in FIG. 2, a clockwise rotating force is imparted to the developer tank 1 by the tension of the tension coil spring 14, causing the guide rollers 7 to come in contact with the surface of the image carrier 8. This allows the gap between the sleeve 4 and the surface of the image carrier 8 to be kept constant.

In this state, as the sleeve 4 is caused to rotate counter-clockwise, the permanent-magnet member 5 and the movable member or paddle means 3 are caused to rotate clockwise. The magnetic carrier and the magnetic toner are agitated uniformly in the developer tank 1 by the movable member or paddle 3, and electrostatically charged by friction, attracted onto the surface of the sleeve 4 by the magnetic attraction of the permanent-magnet member 5, and transferred to a developing area to form a magnetic brush. Thus, the magnetic brush rubs the electrostatic charged image on the surface of the image carrier to make the image visible, that is, to develop the image.

Upon completion of developing operation, or during maintenance inspection, as the lever 12 is turned 90 degrees clockwise, the cam 11 is moved while sliding on the cam surface 13, causing the developer tank 1 to turn 6–10degrees, for example, counterclockwise around the supporting shaft 9. This causes the guide rollers 7 to be disengaged from the surface of the image carrier 8. Since the entire system can be extracted in this state in the direction vertical to the paper surface as necessary, component members can be subjected to maintenance, inspection and repair.

With the developing system having the aforementioned construction, and since the guide rollers 7 are rotated while coming in contact with the surface of the image carrier 8, the gap between the sleeve 4 and the surface of the image carrier 8, that is, the developing gap, can be kept constant. There remains a problem, however, that the developing gap cannot be maintained at a predetermined value over the overall length of the sleeve 4 because the entire system may be distorted or deformed by errors caused during assembly of the developing system and other factors.

The aforementioned developing gap is generally maintained at less than 1 mm, and often within the range of 0.2–0.6 mm when a developer containing a magnetic toner, or a two-component developer using a ferrite carrier is used.

The aforementioned problem is attributable to the fact that the connecting parts of the supporting shaft 9 and the supporting frames 10 are tightly constructed at both ends of the supporting shaft 9, leaving less room, or less play, in engagement. Even when the manufacturing accuracy of the component members, on the other hand, is improved, and the assembly accuracy among the component members are strictly controlled, it is almost impossible to perfectly bring both the guide rollers 7 and the image carrier 8 into contact with each other without errors. Such efforts would prove uneconomical because of an increase in manufacturing cost.

To overcome the aforementioned problems, Japanese Published Examined Utility Model Application No. 33249/1990, for example, proposed a construction that a developing system is disposed on an electrostatographic system by supporting a positioning shaft for the developing system in an almost horizontal position in developing-system supporting grooves provided on the electrostatographic system; one of the supporting grooves being formed into almost the same size as the outside diameter of the positioning shaft, and the other supporting groove being formed into such a size as to allow a slight play with the positioning shaft. This construction, however, can absorb only a localized load generated by the distortion of the developing system itself by the aforementioned play, and is short of reliability because it does not positively push the developing system itself onto the image carrier.

In recent years, on the other hand, the functional and economical requirements for developing systems of this type have been increasingly stringent to such an extent that the conventional systems cannot satisfy such needs.

SUMMARY OF THE INVENTION

This invention is intended to solve the problems inherent in the prior art as described above. It is an object of this invention to provide a developing system in which guide rollers provided at both ends of a developing roll can be forced uniformly onto the surface of an image carrier so as to maintain a developing gap between the developing roll and the surface of the image carrier.

DETAILED DESCRIPTION OF THE EMBODIMENTS

Figure 1:
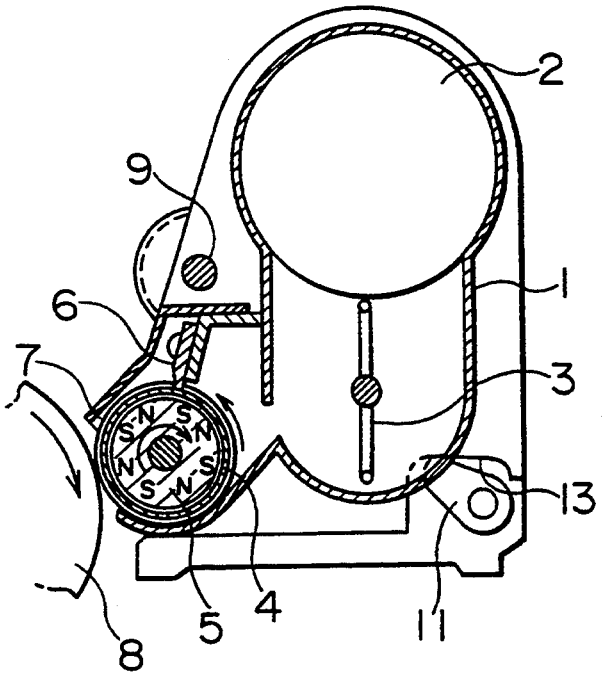
FIG. 1 (PRIOR ART)
FIGS. 1 and 2 are a cross-sectional view and a side view illustrating the essential part of a developing system of a conventional type.
Figure 2:
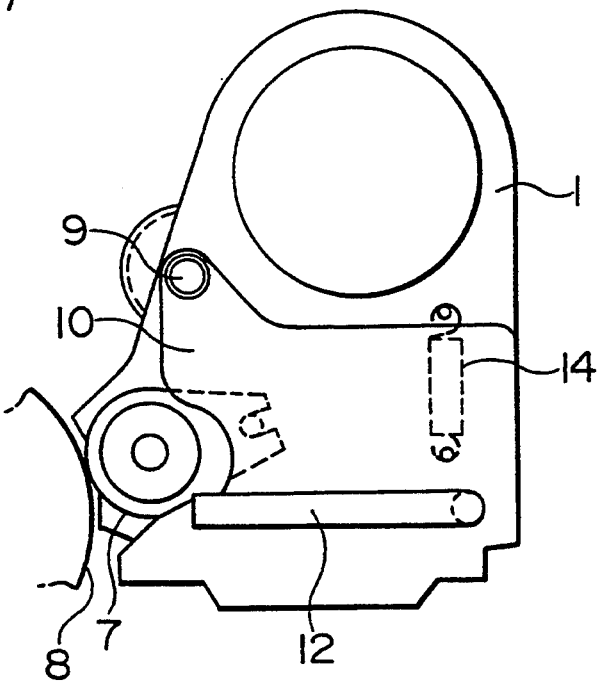
FIG. 2 (PRIOR ART)
Figure 3:
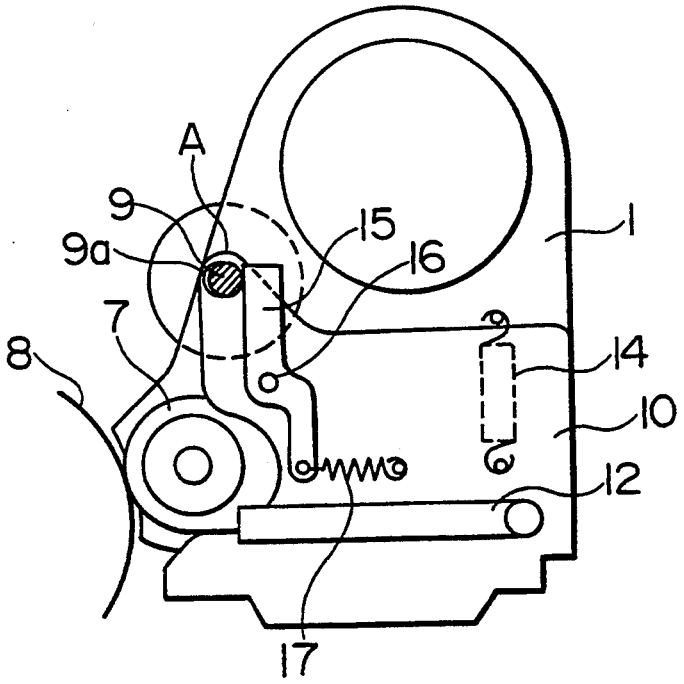
FIG. 3 is a side view showing an embodiment of this invention.
Figure 4:
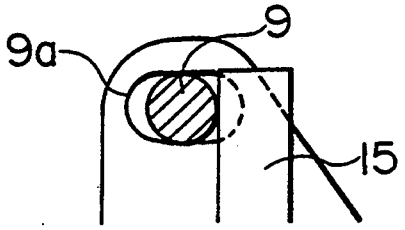
FIG. 4 is an enlarged view of part A in FIG. 3.

FIG. 3 is a side view of an embodiment of this invention, and FIG. 4 is an enlarged view of part A in FIG. 3. Like parts are indicated by like numerals used in FIGS. 1 and 2. In FIGS. 3 and 4, numeral 9*a* refers to a slotted hole provided on one supporting frame 10, with the (vertical) minor diameter thereof formed into a size almost equal to the supporting shaft 9, and the (horizontal) major diameter thereof formed into a size 1-mm larger than the diameter of the supporting shaft 9. Washers and fastening members are provided on both ends of the supporting shaft 9 in such a manner as to restrict the axial relative movement of the supporting shaft 9 with respect to the supporting frames 10.

Numeral 15 refers to a pushing member or means formed in such a manner as to be rotatable around pins 16 provided on one of the supporting frames 10, with an end thereof brought into contact with the supporting shaft 9, and the other end thereof fitted to a tension coil spring 17 so that the supporting shaft 9 is preloaded toward the image carrier 8.

With the aforementioned construction, as the lever 12 is thrown to a position shown in FIG. 3, a rotating force is generated around the supporting shaft 9 in the developer tank 1 by the tension of the tension coil spring 14, causing the guide rollers 7 to come in contact with the surface of the image carrier 8. On one of the supporting frames 10, the relative movement of the supporting shaft 9 with respect to one of the supporting frames 10 in the direction vertical to the supporting shaft 9 is made possible by the slotted hole 9*a*. Thus, even if the rotating shaft of the guide roller 7 is not in parallel with the rotating shaft of the image carrier 8, for example, this non-parallel state can be successfully absorbed by the relative movement between the supporting shaft 9 and one of the supporting frames 10. Since the supporting shaft 9 is pre-loaded toward the image carrier 8 by the pushing member 15 and the tension coil spring 17, the gap between the sleeve (not shown) and the image carrier can be kept at a predetermined value over the entire longitudinal area.

Although description has been made in this embodiment about a permanent-magnet member made of ferrite magnet and formed into a cylindrical shape, other magnetic materials than ferrite magnet can be used. In addition, the permanent-magnet member may be of other shapes than the cylindrical shape as mentioned above; one possible shape being a plurality of magnet blocks fixedly fitted to the outer circumferential surface of the shaft. The difference between the major diameter of a slotted hole provided on one supporting member and the diameter of the supporting shaft should preferably be within 1 mm.

Furthermore, the supporting frame on which the above-mentioned slotted hole is provided should be on the driven side of the sleeve or the guide roller.

Moreover, certain particular magnetic poles of the permanent-magnet member may be fixedly fitted to a location facing the image carrier, with only the sleeve allowed to rotate. In short, the minimum requirement is that there is a relative movement between both component members. As the magnetic developer, one-component developer comprising a magnetic toner, or a two-component developer comprising a magnetic carrier and a nonmagnetic or weak magnetic toner can be used.

This invention having the aforementioned construction and operation has such an effect that a developing gap between the sleeve and the image-carrier surface can be kept constant uniformly over the overall length thereof, leading to a substantial improvement in developing quality.

What is claimed is:

1. A developing roll positioning apparatus comprising:

an image carrier;

a developer tank for containing a developer and positionable adjacent said image carrier, said developer tank also including a developing roll, and first and second guide rollers positioned at first and second ends of said developing roll respectively, said first and second guide rollers having an external diameter larger than an external diameter of said developing roll, said developer tank also including a support shaft positioned substantially in parallel with said developing roll;

first and second support frame means positioned on first and second axial ends of said support shaft respectively and for rotatably supporting said first and second axial ends of said support shaft and said developer tank between a first position positioning said first and second guide rollers adjacent said image carrier and a second position rotationally spaced from said image carrier, said first support frame means holding said first axial end of said support shaft fixed with regard to movements in a plane perpendicular to said support shaft, said second support frame means holding said second axial end of said support shaft movable with regard to movements in said plane perpendicular to said support shaft for positioning said second guide roller in contact with said image carrier when said support shaft, said developing roll and said image carrier are not parallel, said second support frame means defines a slotted hole having a major diameter in said plane perpendicular to said support shaft, said second axial end of said support shaft being positioned in said slotted hole;

pushing means attached to said second support frame means and contacting said second axial end of said support shaft, said pushing means elastically biasing said second axial end of said support shaft toward said image carrier.

2. An apparatus in accordance with claim 1, wherein:

said developing roll is rotatable and includes a sleeve made of non-magnetic material and formed into a hollow cylindrical shape, said developing roll also includes a permanent magnet member in said sleeve and having a plurality of magnetic poles extending in an axial direction;

said developing tank including paddle means for mixing and transferring the developer.

3. An apparatus in accordance with claim 1, further comprising:

spring means for biasing said developing tank into said first position.

4. A developing roll positioning apparatus comprising:

an image carrier;

a developer tank for containing a developer and positionable adjacent said image carrier, said developer tank also including a developing roll, and first and second guide rollers positioned at first and second ends of said developing roll respectively, said first and second guide rollers having an external diameter larger than an external diameter of said developing roll, said developing roll being rotatable and including a sleeve made of non-magnetic material and formed into a hollow cylindrical shape, said developing roll also includes a permanent magnet member in said sleeve and having a plurality of magnetic poles extending in an axial direction, said developing tank also including paddle means for mixing and transferring the developer and a support shaft positioned substantially in parallel with said developing roll;

first and second support frame means positioned on first and second axial ends of said support shaft respectively and for rotatably supporting said first and second axial ends of said support shaft and said developer tank between a first position positioning said first and second guide rollers adjacent said image carrier and a second position rotationally spaced from said image carrier, said first support frame means holding said first axial end of said support shaft fixed with regard to movements in a plane perpendicular to said support shaft, said second support frame means holding said second axial end of said support shaft movable with regard to movements in said plane perpendicular to said support shaft for positioning both said first and second guide rollers in contact with said image carrier when said support shaft, said developing roll and said image carrier are not parallel, said second support frame means defines a slotted hole having a major diameter in said plane perpendicular to said support shaft, said second axial end of said support shaft being positioned in said slotted hole;

pushing means attached to said second support frame means and contacting said second axial end of said support shaft, said pushing means elastically biasing said second axial end of said support shaft toward said image carrier.

* * * * *